United States Patent [19]

Keller et al.

[11] 3,982,657

[45] Sept. 28, 1976

[54] ONE PIECE CONTAINER END MEMBER WITH AN INTEGRAL HINGED OPENING TAB PORTION

[75] Inventors: Jerome Edmund Keller, Lakewood; Ronald Lynn Moore; Harold Cook, Jr., both of Golden, all of Colo.

[73] Assignee: Coors Container Company, Golden, Colo.

[22] Filed: July 28, 1975

[21] Appl. No.: 599,812

[52] U.S. Cl. ..... 220/268

[51] Int. Cl.[2] ..... B65D 41/32

[58] Field of Search ..... 220/268, 269, 265, 266; 222/541

[56] References Cited

UNITED STATES PATENTS

| | | | |
|---|---|---|---|
| 3,881,630 | 5/1975 | Levell et al. | 220/268 |
| 3,902,626 | 9/1975 | Jordan et al. | 220/268 |
| 3,912,114 | 10/1975 | Moran et al. | 220/268 |

*Primary Examiner*—George T. Hall
*Attorney, Agent, or Firm*—Bruce G. Klaas

[57] ABSTRACT

A one piece container end member of metallic sheet material having an exterior rim portion for mounting on an open ended container body member; an interior rim portion axially and radially inwardly offset relative to the exterior rim portion; an axially outwardly domed central wall portion surrounded by the interior rim portion and extending generally radially inwardly relative thereto for closing the open end of the container body member; an integral inwardly severable and displaceable tab portion in the central wall portion extending generally radially inwardly from the interior rim portion; the tab portion being hingedly integrally connected at the interior rim portion by a generally arcuately extending hinge portion; the tab portion being defined by at least one continuous score groove extending from arcuately spaced points adjacent the interior rim portion on opposite sides of the hinge portion generally radially inwardly therefrom toward the central axis of the container end member with intermediate score groove portions extending along substantially straight lines and being connected adjacent the central axis by a curved intermediate score groove portion; the tab portion within the score groove being concave and extending inwardly toward the container body member; and outwardly extending dimple areas in the central wall portion.

31 Claims, 7 Drawing Figures

FIG. 4
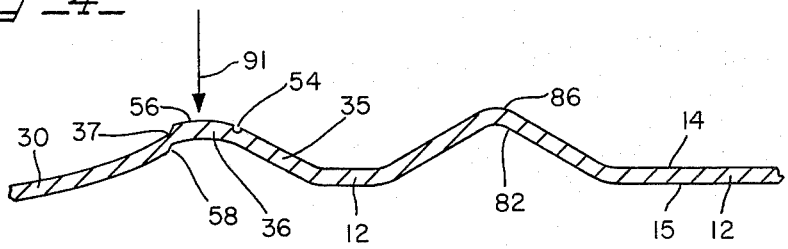
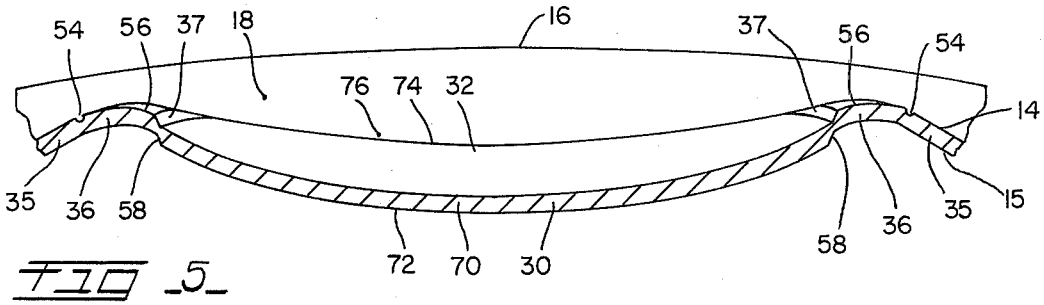
FIG. 5
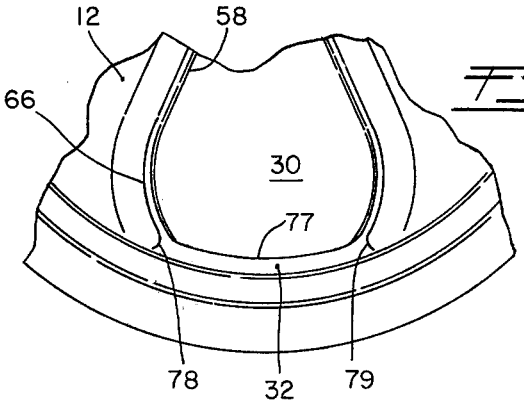
FIG. 6
FIG. 7
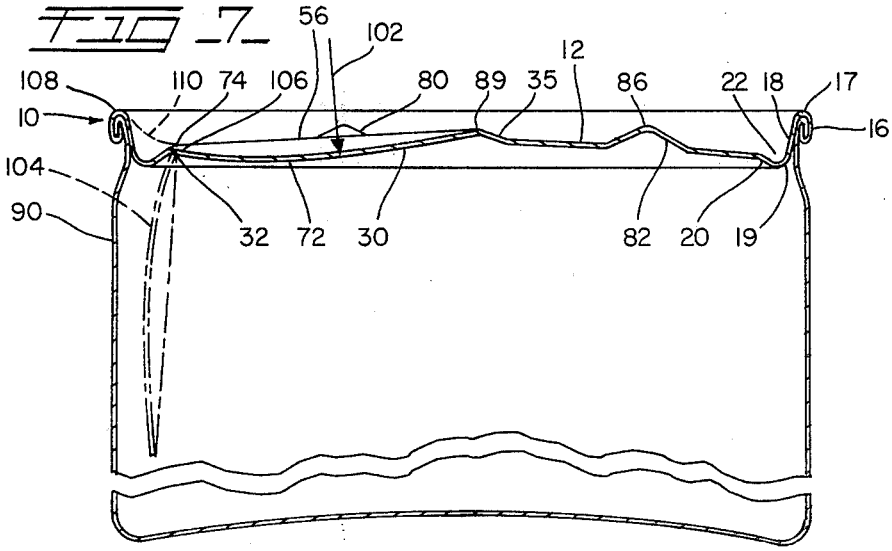

ONE PIECE CONTAINER END MEMBER WITH AN INTEGRAL HINGED OPENING TAB PORTION

BACKGROUND AND SUMMARY OF INVENTION

This invention relates to a new and improved container end member and to new and improved methods of manufacture of a container end member. More particularly, the invention relates to a one piece container and end member of one piece of metallic sheet material adapted to be associated with a container body member to close one end thereof to provide a container member for goods and having an integral tab portion in the container end member axially displaceable to provide access to the contents of the can.

While container end members of the general type described hereabove have been known for some time, the prior designs have not been entirely satisfactory for many reasons. The primary objective of such designs has been to eliminate the use of a container opening arrangement resulting in a separate part which has in the past often been carelessly disposed of by the person opening the container. It has been recognized heretofore that an integral tab portion in the container end member could be provided by a discontinuous score groove leaving an integral hinge area to enable the tab portion to be pushed inwardly into the interior of the container member by severing along the discontinuous score line with the tab portion remaining integrally connected to the container end member at the hinge area as illustrated by U.S. Pat. No. 2,176,898. Prior constructions of this general type have also included a pair of relatively small diameter circular tab portions located in relatively wide radially inwardly spaced relationship to the exterior rim portion of the container end member and in diametrically opposed spaced relationship. The reason for providing a pair of such circular tab portions is that one of the openings provided thereby serves as a spout to pour out the contents of the container while the other opening serves as a vent to enable air to enter the container. Such circular tab portions have been connected to the container end member by relatively narrow width hinge areas with the result that the hinge areas may be severed when the tab portions are inwardly displaced and the completely separated tab portions fall into the container. Such relatively small diameter tab portions have not provided completely satisfactory pouring spout openings. It has been previously suggested that both tab portions be of the same relatively large diameter so that a completely severed tab portion cannot be removed from the container. The concept of providing two relatively large diameter circular openings has not been acceptable because of problems relating to maintaining the required strength in the container end wall member to prevent buckling to enable satisfactory storage of liquids under pressure without destroying the sealed integrity of the container.

The present invention provides a new and improved container end member which has solved many of the problems of prior art devices by enabling the usage of only one relatively large tab portion connected to the container end member by a relatively large hinge area with the results of: alleviating the possibility of completely severing the tab portion; facilitating ease of opening of the container during severing the tab portion from the container end member with application of relatively small force; locating a portion of the opening relatively closely adjacent the exterior rim of the container end member to facilitate pouring out of the contents especially during drinking of beverages from the container; locating a portion of the opening relatively closely adjacent the central axis of the container end member to facilitate entry of air for pouring out of the contents; providing a large surface area on the tab portion readily receiving a person's finger or thumb to press the tab portion into the container; doming the central wall portion of the container end member into convex axially outwardly extending relationship to the exterior rim portion to facilitate opening of the tab portion and pouring and venting of the container contents while providing maximum strength characteristics facilitating assembly of the container end member on a container body member and handling and storage of the container without damage to the sealed integrity of the contents of the container; and forming the tab portion in concave axially inwardly extending relationship to the exterior rim portion to facilitate severing of the tab portion while providing maximum strength characteristics enabling satisfactory manufacture and assembly of the container end member, pressurization of the container, and handling and storage of the container without damage to the sealed integrity of the contents of the container.

BRIEF DESCRIPTION OF DRAWING

The foregoing objectives and results have been attained in an illustrative and presently preferred embodiment of the inventive concepts shown on the accompanying drawings in which:

FIG. 4 is an enlarged cross-sectional view of a portion of the container end member of FIG. 1 taken along line 4—4 in FIG. 1;

FIG. 5 is an enlarged cross-sectional view of another portion of the container end member of FIG. 1 taken along line 5—5 in FIG. 1;

FIG. 6 is a partial bottom plan view of a portion of the container end member of FIG. 1; and FIG. 7 is a side elevational view, partly in cross-section of a container having the container end member of FIGS. 1–6 mounted on a container body member after a doming operation on the container end member.

DETAILED DESCRIPTION

Figure 1:
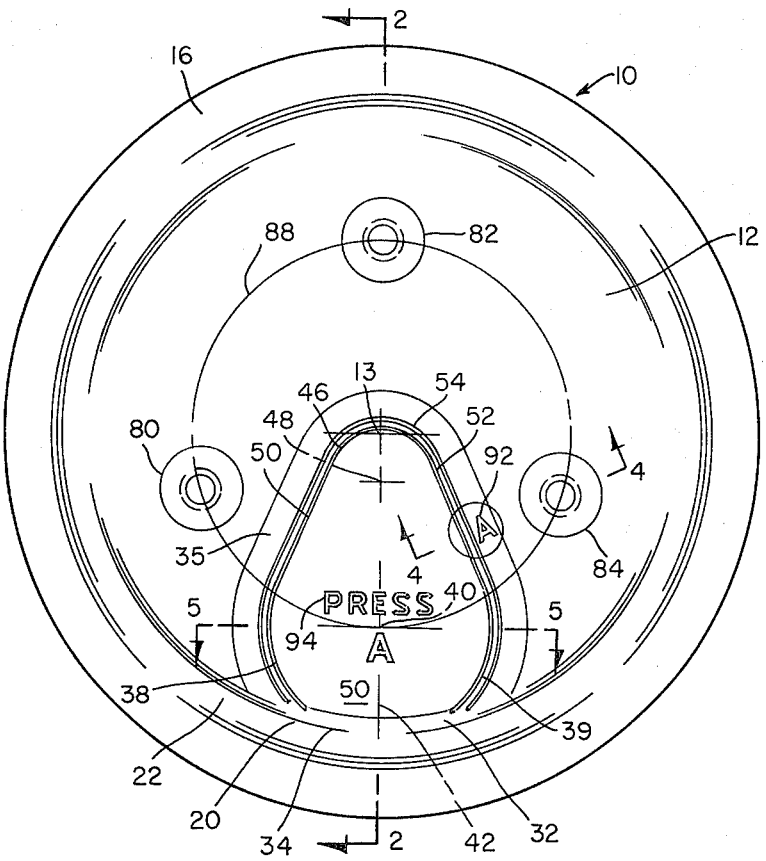
FIG. 1 is a top plan view of a container end member after manufacture and prior to assembly with a container body member.
Figure 2:
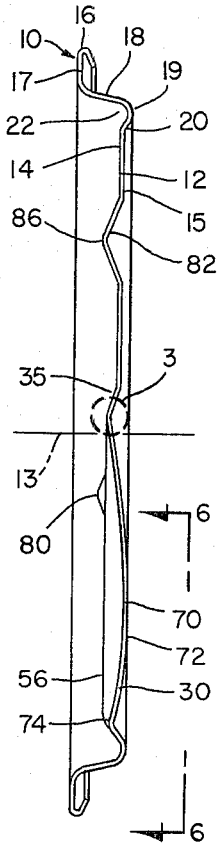
FIG. 2 is a cross-sectional view of the container end member of FIG. 1 taken along the line 2—2.

Referring now to FIGS. 1 and 2, a one piece container end member 10 formed from a blank of sheet metal material such as, for example, an aluminum alloy of approximately 0.0115 inch thickness, is shown to comprise a central annular end wall portion 12, extending radially transversely at substantially right angles to a central axis 13 to provide outer and inner container surfaces 14, 15 when in association with a can body member as shown in FIG. 7. In the presently preferred embodiment, center portion 12 is axially inwardly offset from an annular exterior rim portion 16 having an axially outwardly facing end surface 17 and integrally connected thereto by a generally axially slightly radially inwardly extending flange portion 18, a rounded interior rim portion 19 located inwardly beyond the center portion 12, and a generally radially inwardly slightly axially extending inclined flange portion 20 defining an annular axially outwardly opening groove 22 between flange portion 18 and center portion 12. While there are certain advantages in the arrangement of the present preferred embodiment, it is to be understood that the center portion 12 may be variously otherwise connected to the rim portion 16 by any suitable connecting flange portion structure.

Container opening means are provided in center portion 12 in the form of a partially severable tab portion 30 having a relatively wide (i.e. 0.540 inch in the presently preferred embodiment) hinge area 32 extending generally arcuately along the juncture 34 of flange portion 20 with center portion 12. Tab portion 30 is generally axially inwardly offset relative to center portion 12 and connected thereto by an axially outwardly inclined flange portion 35 and a rounded rim portion 36. The peripheral configuration of tab portion 30 is defined by a first peripherally interior score line groove 37 in outside surface 14 of center portion 12, generally located at the juncture between tab portion 30 and rim portion 36. Groove 37 comprises opposite radially outermost arcuate portions 38, 39 having a common center at 40 on a radial line 42 extending from the central axis 13 of the end member 10; an arcuate radially innermost portion 46 extending slightly beyond the central axis 13 and having a center at 48 on radial line 42; and opposite generally radially extending straight line portions 50, 52 tangentially connected to arcuate portions 38, 39, 46. A second peripherally exterior score line groove 54 in the outside surface 14 of center portion 12 is slightly outwardly spaced from groove 37 adjacent the juncture of flange portion 35 and rim portion 36 to provide a relatively narrow width (e.g. 0.0285 inch) land area 56 therebetween which groove 54 and land area 56 have the same general contour as groove 37 so as to extend thereabout in spaced generally parallel relationship therewith. A third score line groove 58, FIGS. 3 and 4, of the same peripheral configuration as score line groove 37, is located at the juncture of rim portion 36 and tab portion 30 in interior surface 15 of center portion 12.

Figure 3:
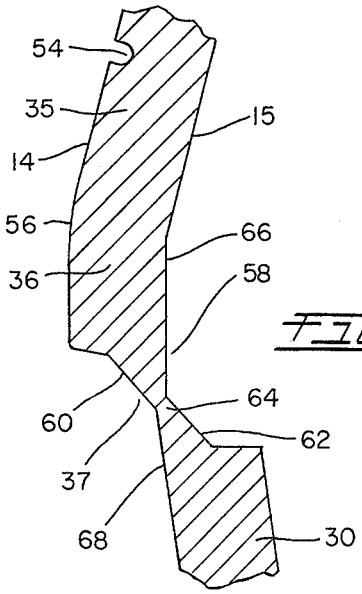
FIG. 3 is an enlarged partial view of a tab portion score area of the container end member of FIG. 1.

As shown in FIG. 3, score line grooves 37, 58 are located in juxtaposition to provide generally parallel inclined surfaces 60, 62, the inner end portions of which may slightly overlap to define a shear area 64, having a relatively narrow width (e.g. 0.0025 inch) transverse to surfaces 60, 62, with the adjacent inner surface 66 of the rim portion 36 being substantially parallel to and slightly inwardly offset (e.g. 0.0005 inch) relative to the adjacent outer surface 68 of the tab portion 30.

As shown in FIGS. 2 and 5, the tab portion 30 is of compound curvature with the central portion 70 along the radial line 42 being furthest axially inwardly displaced such that the innermost surface area 72 is located approximately in coplanar relationship with rim portion 19. The surface 74, FIG. 5, along the hinge area 32 is axially inwardly offset relative to the land area 56 to provide a saddle-like depression 76. As shown in FIG. 6, the hinge action is facilitated by a forming line 77 caused by providing a relatively sharp edge on the forming tooling and by outwardly curved terminal portions 78, 79 of the outer edge of the land area 66 adjacent score groove 58. The arcuate score groove portions 38, 39 are arranged so as to terminate radially outwardly adjacent the ends of the hinge area 32 and so that a radially outward extension thereof would intersect an arc extending circumferentially along the hinge area rather than being tangential thereto as in a prior art circular tab portion configuration. As a result, the hinge area has a width sufficient to receive and support a person's finger during opening without coming into contact with any significant portion of the shear area 64 along the score grooves 37, 58.

Axially outwardly extending dimple means in the presently preferred form of three relatively equally circumferential spaced dimple areas 80, 82, 84 are provided to protect the score groove areas with the axially outermost coplanar dimple surfaces 86 being axially outwardly offset relative to the land area 56 of rim portion 36 a distance of, for example, 0.019 inch, with outer surface 86, the outer surface of land area 56, and the outer surface 14 of center portion 12 being axially inwardly offset from rim portion surface 17 0.120 inch, 0.139 inch and 0.175 inch, respectively. As shown in FIG. 1, the dimple areas are located on an arc 88 approximately radially aligned with the juncture of curved portions 38, 39 and straight portions 50, 52 of the periphery of the tab portion 30 with one dimple area 82 located on radial line 42 opposite the tab portion and the other two dimple areas 80, 84 located relatively closely adjacent the straight portions of the score groove areas between the curved portions of the score groove areas.

After container end member 10 of FIGS. 1–6 has been formed as described hereinabove, central wall portion 12 is axially outwardly domed so that in the final form of container end member 10 the central portion 12 is generally axially outwardly inclined as shown in FIG. 7. In the final domed configuration, the dimple area outer surfaces 86 and the land area outer surface 89 adjacent central axis 13 are axially offset from rim portion surface 17 distances of, for example, 0.085 inch and 0.090 inch, respectively, so that outer surfaces 86 are axially outwardly offset relative to outer surface 89 a distance of, for example, 0.005 inch. The residual pre-form stresses in concave tab portion 30 and surrounding flange 35 and rim portion 36 provide higher resistance to the doming operation forces than the center portion 12 with the result that inner surface 72 and the hinge area 32 of tab portion 30 are not axially displaced or only very slightly axially displaced during the doming operation with the amount of axial displacement along the rim portion 36 varying from little or none at the hinge area to a maximum at surface 89. The doming of the center portion 12 provides greater flexibility with the result that the score groove means 37, 54 can withstand a certain amount of flexing of the center portion without being severed to reduce the possibility of inadvertent severance during manufacture, assembly, storage and handling while at the same time enabling deliberate opening by severance under application of less digitally applied forces.

In order to open a container end member after it has been mounted in conventional sealed relationship along rim portion 16 with a container body member 90 (FIG. 7) to hold, for example, beer, which under conditions for which the presently preferred embodiment is intended is pressurized to, for example, 12 to 14 p.s.i., and which under abnormally high temperature conditions may reach as much as 60 to 120 p.s.i., an axially inwardly directed manually digitally applied force, of, for example, 6 to 12 pounds and preferably 8 to 10 pounds, is applied on the land area 56 of the rim portion 36 in the direction of the arrow 91, FIG. 4. While the force may be applied at any position along the rim portion 36, it has been determined that best results are obtained if the force is applied midway along one of the straight portions of the score area as indicated by the mark 92 in FIG. 1 which, along with suitable instructions provided at 94 on the outer surface of the tab portion, may be suitably embossed on the container end member 10 at the time of manufacture along with such other markings as may be required. When sufficient axially directed force is applied at a selected portion of the land area 56, a small section of the tab portion 30 at the location of application of the force is severed from the rim portion 36 in the shear area 64 with the rim portion surface 60 and the tab portion surface 62 moving in opposite directions toward one another due to the residual forming forces in the flange portion 35 and rim portion 36 effective to slightly displace the edge area of the rim portion adjacent surface 60 inwardly toward the tab portion and in the tab portion 30 effective to slightly displace the edge area of the tab portion adjacent surface 62 outwardly toward the rim portion 36. Once a portion of the score area has been severed, the remaining portions of the score area are easily further severed by pushing axially inwardly on the outer concave surface of the tab portion 30 in the direction of the arrow 102, FIG. 7, the contour of which is such as to conformably receive a person's finger or thumb for that purpose. As the tab portion is inwardly displaced by axially inwardly applied force, the tab portion is pivotally inwardly displaced into the container about hinge axis 77 in hinge area 32 by which the tab portion remains integrally connected to the container end member 10. The shearing action is such as to provide a sheared surface generally transversely intersecting the inclined smooth score groove surface 60 on the rim portion. Once the shearing action has begun, the outer surface 68 of the tab portion is in restrictive abutting engagement with the inner surface 66 of the rim portion 36 to preclude axial outward displacement of the tab portion whereby the tab portion can only be pushed further axially inwardly into the container.

When tab portion 30 has been completely severed from rim portion 36 along score line grooves 37, 58, the tab portion may be easily pushed into the container so as to extend generally axially inwardly therewithin as shown at 104, FIG. 7. The forming line 77 along the bottom surface of the hinge area provides a hinge axis while outwardly curved portions 78, 79 of the land area 66 adjacent score groove 58 prevent tearing at the ends of the hinge area. In the open position at 104, FIG. 7, the inner curved portion of the opening at 46 provides good venting while the concave surface 74 and saddle area 76 defined thereby provide a pouring spout channel through flange portion 20 relatively closely adjacent outer rim portion 16 of container end member 10. In addition, the concave surface 74 and the adjacent concavely curved surface 106 of tab portion 30 provide a pour spout surface extending generally outwardly relative to and toward the inner edge surface 108 of rim portion 16, FIG. 7. Consequently, the pourability characteristics of the container end member are quite good compared to prior arrangements.

In order to manufacture the aforedescribed container end member 10 from sheet metal stock such as an aluminum alloy suitably sized blanks of the sheet stock are first formed to provide the exterior rim portion 16, the flange portion 18, the interior rim portion 19, and the flange portion 20, then the dimple areas 82, the mark 92, the instruction 94, and any other marking to be provided on the end member 10 are embossed in the center portion 12 by a press operation. Then the central portion 12 is further formed and scored in a continuous operation to provide, in sequence of initiation of the forming steps, first the formed tab member 30, then the flange portion 35, then the score groove 37 and the score groove 58, and then the score groove 54, the forming tooling being arranged to sequentially initiate and complete the foregoing further forming and scoring of the center portion during one stroke of a press by which such further forming and scoring is accomplished. As a result, the tab portion is first partially formed which draws sufficient material into the tab portion area to give it strength to prevent buckling. The score groove 54, which preferably may have a relatively large depth of 0.005 inch, serves as a block against any substantial outwardly directed displacement of metal in rim portion 36. The container end member then has the constructional form as hereinbefore described in reference to FIG. 2.

In the presently preferred method, the container end member is then further formed into the shape shown in FIG. 7 wherein the central end wall portion 12 is axially outwardly domed with the axially outermost surfaces of the dimple areas 80, 82, 84 being equally axially outwardly located more closely adjacent the axially outermost surface 17 of rim portion 16 than prior to the doming operation. In addition, portions of the outer surface of the land area 56 are also located more closely adjacent the axially outermost surface 17 of rim portion 16 than prior to the doming operation but since various portions of the land area are located at different radial inward distances from the rim portion 16, the various portions are located various axial distances from the rim portion 16 with the portions adjacent the central axis 13 being most closely axially spaced from surface 17 of rim portion 16 and with the portions adjacent the rim portion 19 having little or no axial displacement and being furthest axially spaced from surface 17 of rim portion 16. Thus, the tab portion 30 is generally radially inwardly axially outwardly inclined relative to rim portion 19. It is contemplated that the doming operation may be performed prior to the forming operation hereinbefore described. The arrangement is such that after the doming operation, the land area adjacent the central axis 13 is more closely axially spaced from the axially outermost surfaces of dimple areas 80, 82, 84 with, for example, the axial distance of 0.019 inch of FIG. 2 having been reduced to 0.005 inch after doming. The doming operation may be conveniently performed in conventional container end seal testing apparatus by which the rim portion 16 is fixedly secured and sealed on the test apparatus with the inner surface 15 of the container end member being subject to axially outwardly directed force in the form of high pressure air at, for example, between 50 to 60 p.s.i. which will also enable detection of any defects in the sealable integrity of the container end member such as breaks or insufficiency of strength in the score grooves 37, 58.

While inventive concepts have been herein disclosed by reference to an illustrative and presently preferred embodiment of the invention, it is contemplated that the inventive concepts may be variously otherwise embodied in alternative forms of container end members and methods of manufacture thereof. Thus, it is intended that the appended claims be construed to include alternative forms of container end members and methods of manufacture thereof except insofar as precluded by the prior art.

The invention claimed is:

1. A container end member, for sealed association with a container body member to provide a sealed container, comprising:

a generally annular one piece sheet of material having a central axis;

an outer annular rim portion for sealed association with the container body member;

a central end wall portion integrally connected to said rim portion and extending generally transversely relative to said central axis; and a severable and displaceable tab portion in and integrally connected to said central end wall portion having:

an integral hinge portion having circumferentially spaced opposite ends and being located adjacent said outer annular rim portion and extending in generally circumferentially parallel closely spaced relationship relative thereto; and severable score groove means defining a severable wall portion for (separating) severing said tab portion from said central wall portion by axially inwardly directed forces, said score groove means and said severable wall portion extending from said opposite ends of said hinge portion generally radially inwardly relative to said outer annular rim portion toward said central axis and being located in part closely adjacent said central axis and defining a radially elongated and circumferentially extending tab portion area axially inwardly displaceable relative to said central end wall portion by pivotal movement about said hinge portion to provide an opening for the container having a vent portion adjacent said central axis and a pouring portion adjacent said rim portion.

2. The invention as defined in claim 1 and said severable score groove means further comprising:

a pair of circumferentially spaced substantially straight portions extending generally radially between said hinge portion and said central axis.

3. The invention as defined in claim 2 and said severable groove means further comprising:

a curved end portion connecting said straight portions generally radially inwardly opposite said hinge portion and extending closely adjacent said central axis.

4. The invention as defined in claim 3 and said severable groove means further comprising:

a pair of circumferentially spaced curved end portions next adjacent said hinge portion.

5. The invention as defined in claim 4 and said severable score groove means further comprising:

said pair of circumferentially spaced curved end portions being circumferentially spaced a greater distance apart adjacent said hinge portions that the circumferential spacing between said straight portions adjacent said curved end portion.

6. The invention as defined in claim 5 and said severable score groove means further comprising:

said pair of circumferentially spaced curved end portions having a common center located on a radial line extending outwardly from said central axis and circumferentially spaced midway between said straight portion;

said curved end portion having a center located on said radial line; and said straight portions extending tangentially relative to said pair of circumferentially spaced curved end portions and to said curved end portion.

7. The invention as defined in claim 1 and said severable and displaceable tab portion further comprising:

a circumferentially extending forming line on the axially inner surface of said central end wall portion extending circumferentially along said hinge portion to provide a hinge axis for said tab portion.

8. The invention as defined in claim 7 and said severable score groove means further comprising:

an inner score groove on the axially inner surface of said central end wall portion;

said inner score groove terminating adjacent said hinge portion in circumferentially spaced relationship to said forming line and being circumferentially outwardly curved relative to said forming line.

9. The invention as defined in claim 1 and said severable and displaceable tab portion being concavely axially inwardly displaced relative to said central end wall portion.

10. The invention as defined in claim 9 and said severable and displaceable tab portion further comprising:

a concave axially inwardly extending saddle area in the axially outer surface of said central end wall portion extending circumferentially along said hinge portion.

11. The invention as defined in claim 1 and said central end wall portion extending convexly axially outwardly relative to said outer annular rim portion.

12. The invention as defined in claim 1 and further comprising:

circumferentially spaced axially outwardly extending dimple areas in said central end wall portion having axially outermost surfaces located axially outwardly beyond said score groove means.

13. The invention as defined in claim 12 and wherein said dimple areas being located radially outwardly of said central axis between said central axis and said outer annular rim portion and being circumferentially spaced relative to said score groove means.

14. The invention as defined in claim 12 and wherein said dimple areas further comprising:

three circumferentially and radially spaced dimple areas, said score groove means extending between two of said dimple areas in equally circumferentially spaced relationship thereto; and the third of said dimple areas being located in radial alignment with and opposite to said hinge portion.

15. The invention as defined in claim 14 and said central end wall portion extending convexly axially outwardly relative to said outer annular rim portion.

16. The invention as defined in claim 15 and said severable and displaceable tab portion being concavely axially inwardly displaced relative to said central end wall portion.

17. The invention as defined in claim 1 and further comprising:

an annular connecting flange portion between said outer annular rim portion and said central end wall portion;

an internal annular rim portion between said connecting flange portion and said central end wall portion;

an axially outwardly inclined flange portion between said tab portion and said central end wall portion; and an axially outwardly convexly extending rim portion between said axially outwardly inclined flange portion and said tab portion.

18. The invention as defined in claim 17 and said score groove means further comprising:

a first external score groove on the axially outer surface of said central end wall portion between said axially outwardly convexly extending rim portion and said tab portion; and a second internal score groove on the axially inner surface of said central end wall portion between said axially outwardly convexly extending rim portion and said tab portion located in juxtaposition to said first external score groove to define a severable shear area therebetween.

19. The invention as defined in claim 18 and said score groove means further comprising:

a third external score groove means on the axially outer surface of said central end wall portion between said axially outwardly extending flange portion and said axially outwardly convexly extending rim portion.

20. The invention as defined in claim 19 and said central end wall portion extending convexly axially outwardly relative to said internal annular rim portion.

21. The invention as defined in claim 20 and said severable and displaceable tab portion being concavely axially inwardly displaced relative to said central wall portion.

22. A container end member, for sealed association with a container body member to provide a sealed container, comprising:

a generally annular one piece sheet of material having a central axis;

an outer annular rim portion for sealed association with the container body member;

a central end wall portion integrally connected to said rim portion and extending generally transversely relative to said central axis; and a severable and displaceable tab portion in said central end wall portion having:

an integral hinge portion adjacent said outer annular rim portion; and severable score grove means, for separating said tab portion from said central wall portion by axially inwardly directed forces, extending from said hinge portion generally radially inwardly relative to said outer annular rim portion toward said central axis and being located in part closely adjacent said central axis and defining a radially elongated and circumferentially extending tab portion area axially inwardly displaceable relative to said central end wall portion by pivotal movement about said hinge portion to provide an opening for the container having a vent portion said central axis and a pouring portion adjacent said rim portion; and said score groove means having a pair of circumferentially spaced substantially straight portions extending generally radially between said hinge portion and said central axis, a curved end portion connecting said straight portions and being located generally inwardly in spaced opposite relationship to said hinge portion and extending closely adjacent said central axis; a pair of circumferential spaced curved end portions next adjacent said hinge portion and extending between said hinge portion and said straight portions; and said pair of circumferentially spaced end portions adjacent said hinge portion being circumferentially spaced a greater distance apart than the circumferential spacing between said straight portions adjacent said curved end portion.

23. The invention as defined in claim 22 and said severable score groove means further comprising:

said pair of circumferentially spaced curved end portions having a common center located on a radial line extending outwardly from said central axis and circumferentially spaced midway between said straight portion;

said curved end portion having a center located on said radial line; and said straight portions extending tangentially relative to said pair of circumferentially spaced curved end portions and to said curved end portion.

24. A container end member for sealed association with a container body member to provide a sealed container and comprising:

a generally annular one piece sheet of material having a central axis; an outer annular rim portion for sealed association with the container body member;

a central end wall portion integrally connected to said rim portion and extending generally transversely relative to said central axis; and a severable and displaceable tab portion in and integrally connected to said central end wall portion; said tab portion comprising:

an integral hinge portion adjacent said outer annular rim portion and extending in generally circumferentially parallel closely spaced relationship to said rim portion between circumferentially spaced terminal portions of said integral hinge portion;

score groove means on the periphery of said tab portion for defining a severable wall area of reduced thickness relative to the thickness of said central end wall portion integrally connecting said tab portion to said central wall portion and for severing said tab portion from said central end wall portion by axially inwardly directed forces applied adjacent said severable wall area; said score groove means extending continuously from and between said spaced terminal portions of said hinge portion and extending generally radially inwardly relative to said outer annular rim portion toward said central axis; said score groove means having a radially innermost portion located closely adjacent said central axis; said score groove means defining a radially elongated and circumferentially extending tab portion in and integrally connected to said central end wall portion;

said tab portion having a radial length between said integral hinge portion and said central axis greater than any circumferential width of said tab portion; and said tab portion being severable from said central end wall portion along the entire length of said score groove means by axially inwardly applied forces and axially inwardly displaceable relative to said central end wall portion by pivotal movement about said hinge portion to provide an opening for the container having a vent portion adjacent said central axis and a pouring portion adjacent said outer annular rim portion.

25. A container end member for sealing association with a container and comprising:

a central wall portion with at least one partially severable and displaceable tab forming wall portion of smaller area than the central wall portion for providing access to the container;

the tab forming portion being permanently connected to the end member by an integral hinge wall portion adjacent the outer rim of the end member, and the tab forming wall portion being defined by severable score groove means defining a severable wall portion for separating the tab forming wall portion from the end member by forces directed axially inwardly relative to the container and for defining a tab wall portion displaceable by pivotal movement about the hinge portion into the container;

the score groove means and severable wall portion extending from opposite ends of said hinge portion generally transversely inwardly relative to the outer rim of the end member and having innermost portions located closely adjacent the central axis of the end member;

the score groove means and severable wall portion defining an inwardly elongated tab wall portion area having a length greater than the width; and the tab wall portion being axially inwardly displaceable relative to the central wall portion by pivotal movement about said hinge wall portion to provide an opening for the container having a vent portion located adjacent the central axis of the end member and a pouring portion located adjacent the outer rim of the container.

26. The invention as defined in claim 25 and further comprising:

a deflectable flange wall portion formed in said central wall portion and corresponding in peripheral configuration to said score groove means and said severable wall portion, said score groove means and said severable wall portion being formed in said deflectable flange wall portion, and said tab forming wall portion being of axially inward concave cross-sectional configuration and extending at least in part axially inwardly beyond said central wall portion of the container end member.

27. The invention as defined in claim 26 and wherein said score groove means and said severable wall portion further comprising:

a pair of spaced elongated score groove portions and severable wall portions extending generally transversely inwardly relative to the outer rim of the end member, one of said pair of spaced elongated score groove portions and severable wall portions extending inwardly from and defining one end of said hinge wall portion and the other of said pair of spaced elongated score groove portions and severable wall portions extending inwardly from and defining the other end of said hinge wall portion, and a connecting score groove portion and severable wall portion extending between said pair of spaced elongated score groove portions and severable wall portions and being located at least in part closely adjacent the central axis of the end member opposite and in inwardly spaced relationship to said hinge wall portion.

28. The invention as defined in claim 24 and wherein said central end wall portion being axially outwardly domed and the portion of said central end wall portion at said central axis being located axially outwardly further than the peripheral portions of said central end wall portion next adjacent said rim portion.

29. The invention as defined in claim 28 and wherein said score groove means being axially outwardly inclined between said rim portion and said central axis and being located further axially outwardly at said central axis than at said rim portion.

30. The invention as defined in claim 29 and further comprising:

an axially outwardly extending rib portion formed in said central end wall portion; and said score groove means being located on said rib portion in axially outwardly spaced relationship to said central end wall portion.

31. The invention as defined in claim 30 and wherein:

said rib portion extending in cantilever fashion from said hinge portion toward said central axis and defining elongated generally radially inwardly extending axially inwardly deflectable support arm means for increasing the deflectability of radially innermost portions of said score groove means on said rib portion located radially more closely adjacent said central axis than said hinge portion and for reducing the amount of axially inwardly directed force required to be applied on said score groove means at said radially innermost portions to initiate severance of said tab portion from said central end wall portion.

* * * * *